US007644743B2

(12) United States Patent
Fenton et al.

(10) Patent No.: US 7,644,743 B2
(45) Date of Patent: Jan. 12, 2010

(54) PIVOTABLE TOWING ARRANGEMENT

(75) Inventors: Timm J. Fenton, Califon, NJ (US); Paul V. Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 735 days.

(21) Appl. No.: 10/829,412

(22) Filed: Apr. 21, 2004

(65) Prior Publication Data

US 2005/0236242 A1 Oct. 27, 2005

(51) Int. Cl.
*A45C 13/26* (2006.01)
*A45C 5/14* (2006.01)

(52) U.S. Cl. ..... 150/115; 150/39; 16/113.1; 16/405; 280/37; 280/655.1

(58) Field of Classification Search ..... 190/39, 190/115; 16/113.1, 114.1, 405; 280/37, 280/655.1
See application file for complete search history.

(56) References Cited

U.S. PATENT DOCUMENTS

| | | | | |
|---|---|---|---|---|
| 1,616,632 | A | 2/1927 | Mastrontonio | 280/79.2 |
| 4,062,429 | A | 12/1977 | Tabor et al. | 190/18 |
| 5,000,467 | A | 3/1991 | Becca | 280/47.24 |
| 5,265,307 | A | 11/1993 | Hull et al. | 16/114 |
| 5,339,934 | A | 8/1994 | Liang | 190/18 |
| 5,353,900 | A | 10/1994 | Stilley | 190/18 |
| 5,464,080 | A | 11/1995 | Liang | 190/18 |
| 5,706,921 | A | 1/1998 | Wang | 190/115 |
| 5,806,143 | A | 9/1998 | Tsai | 16/115 |
| 5,890,570 | A | 4/1999 | Sadow | 190/18 |
| 6,302,250 | B1 | 10/2001 | Sadow et al. | 190/18 |
| 6,317,924 | B1 | 11/2001 | Gallagher | 16/114.1 |
| 6,357,080 | B1 | 3/2002 | Tsai | 16/113.1 |
| 6,434,790 | B1 | 8/2002 | Chen | 16/113.1 |
| 6,470,533 | B1 | 10/2002 | Comstock | 16/445 |
| 6,508,344 | B1 | 1/2003 | Lu | 190/115 |
| 6,530,459 | B1 | 3/2003 | Lu | 190/115 |
| 6,564,426 | B1 * | 5/2003 | Wang | 16/113.1 |
| 6,591,951 | B1 | 7/2003 | Chen | 190/115 |
| 6,651,791 | B1 | 11/2003 | Nykoluk et al. | |
| 6,651,992 | B1 | 11/2003 | Smith, Sr. | 280/47.26 |
| 6,668,423 | B1 * | 12/2003 | Chen | 16/113.1 |
| 6,892,866 | B2 | 5/2005 | Wu | |
| 6,898,823 | B2 * | 5/2005 | Tsai | 16/405 |
| 2002/0014382 | A1 | 2/2002 | Kuo | |
| 2002/0144874 | A1 | 10/2002 | Nykoluk et al. | |
| 2003/0079950 | A1 * | 5/2003 | Lin et al. | 190/115 |
| 2003/0085089 | A1 | 5/2003 | Lin et al. | |
| 2003/0132080 | A1 | 7/2003 | Dababneh | |

(Continued)

FOREIGN PATENT DOCUMENTS

| | | |
|---|---|---|
| DE | 3636064 | 4/1988 |

(Continued)

*Primary Examiner*—Sue A Weaver
(74) *Attorney, Agent, or Firm*—Baker Botts L.L.P.

(57) ABSTRACT

A towing arrangement includes a pivotal handle which allows a user to position the handle more comfortably that would otherwise be possible with a conventional towing arrangement. The relative motion of the handle can also increase the maneuverability of a piece of luggage by eliminating the need for a person to reposition his or her hand on the handle when attempting to redirect the piece of luggage.

34 Claims, 5 Drawing Sheets

U.S. PATENT DOCUMENTS

| | | | | |
|---|---|---|---|---|
| 2004/0181906 | A1 | 9/2004 | Kuo et al. | |
| 2004/0182665 | A1 | 9/2004 | Scicluna et al. | |
| 2005/0016809 | A1* | 1/2005 | Wu | 190/115 |
| 2005/0087415 | A1 | 4/2005 | Gorga et al. | |
| 2005/0145459 | A1* | 7/2005 | Lu | 190/115 |
| 2005/0183914 | A1 | 8/2005 | Lin | |
| 2006/0076203 | A1 | 4/2006 | Miller | |

FOREIGN PATENT DOCUMENTS

| | | |
|---|---|---|
| FR | 2371178 | 7/1978 |
| WO | WO01/52687 | 7/2001 |

* cited by examiner

PIVOTABLE TOWING ARRANGEMENT

FIELD OF THE INVENTION

This invention relates generally to towable travel luggage, and more particularly to a towing arrangement with a pivotal handle which allows a user to position the handle more comfortably than would otherwise be possible with a conventional towing arrangement.

BACKGROUND INFORMATION

Many varieties of luggage today come equipped with wheels from the manufacturer to enable a user to roll rather than carry or drag his or her luggage when traveling. Typically, such bags come equipped with a towing arrangement, which is sometimes simply a strap attached to the bag but is more often a handle attached to an extendable tubular member which is extended when the luggage is being towed. When the luggage is not being towed, the extendable tubular member is generally left in the retracted position, and thus generally does not affect the outer dimensions of the bag. The length of the tubular member is typically such that it prevents the luggage from coming into contact with the user's legs and feet while it is extended and the luggage is being towed.

The typical conventional towing arrangement is depicted in FIG. 1. A piece of luggage 110 includes two telescoping poles 116, connected by a towing handle 118, which slide into receptacles attached to the piece of luggage 110. This type of luggage generally also has a receptacle for the towing handle such that the towing handle lies flush with an exterior surface of the piece of luggage when the towing arrangement is retracted.

Extendable towing arrangements generally include a mechanism for locking the towing arrangement in the extended and in the retracted positions. Such mechanisms can include spring loaded detents, cam locks, and other interference locks and interference fits. Some mechanisms require manual operation of the release mechanism to extend and/or retract the tubular member. Some mechanisms are automatically released by a sufficient amount of force to extend and/or retract the tubular member.

Conventional towing arrangements have some drawbacks despite their convenience over simply carrying the piece of luggage. The positioning and shape of the towing handle of most towing arrangements can make towing a piece of luggage awkward and uncomfortable. This is primarily because the person towing the bag must tow the bag with his or her wrist turned to its extreme in either one direction or the other when gripping the towing handle. Thus, maneuverability of the luggage becomes limited by the person's ability to further twist his or her wrist.

SUMMARY OF THE INVENTION

One approach to overcoming the shortcomings of the prior art is disclosed in commonly assigned U.S. Pat. No. 6,857,512, entitled "Selectively Rotatable Handle Assembly for Towable Luggage," which is hereby incorporated by reference in its entirety. One of the objects of the present invention is to overcome the aforementioned problems and deficiencies and to provide further improvements to the invention disclosed in U.S. Pat. No. 6,857,512.

For example, an exemplary embodiment of the present invention provides a towing arrangement in which the handle can be pivotally connected to the tubular member. The relative motion between the handle and the tubular member can allow a person to tow the piece of luggage in a more comfortable position than in the prior art. This is because the person can grasp the handle with his or her wrist facing his or her waist, rather than facing the ground or the ceiling as with conventional towing arrangements. The relative motion can also increase the maneuverability of a piece of luggage by eliminating the need for a person to reposition his or her hand on the handle when attempting to redirect the piece of luggage. The relative motion that can allow the handle to be oriented so that a person gripping it has his or her wrist facing his or her waist, also can permit the handle to be rotated approximately 90 degrees from that direction when the towing arrangement is retracted for storage. This orientation may be preferred for the retracted position, because towing arrangements are generally placed immediately adjacent to an exterior surface of the luggage.

Figure 1:
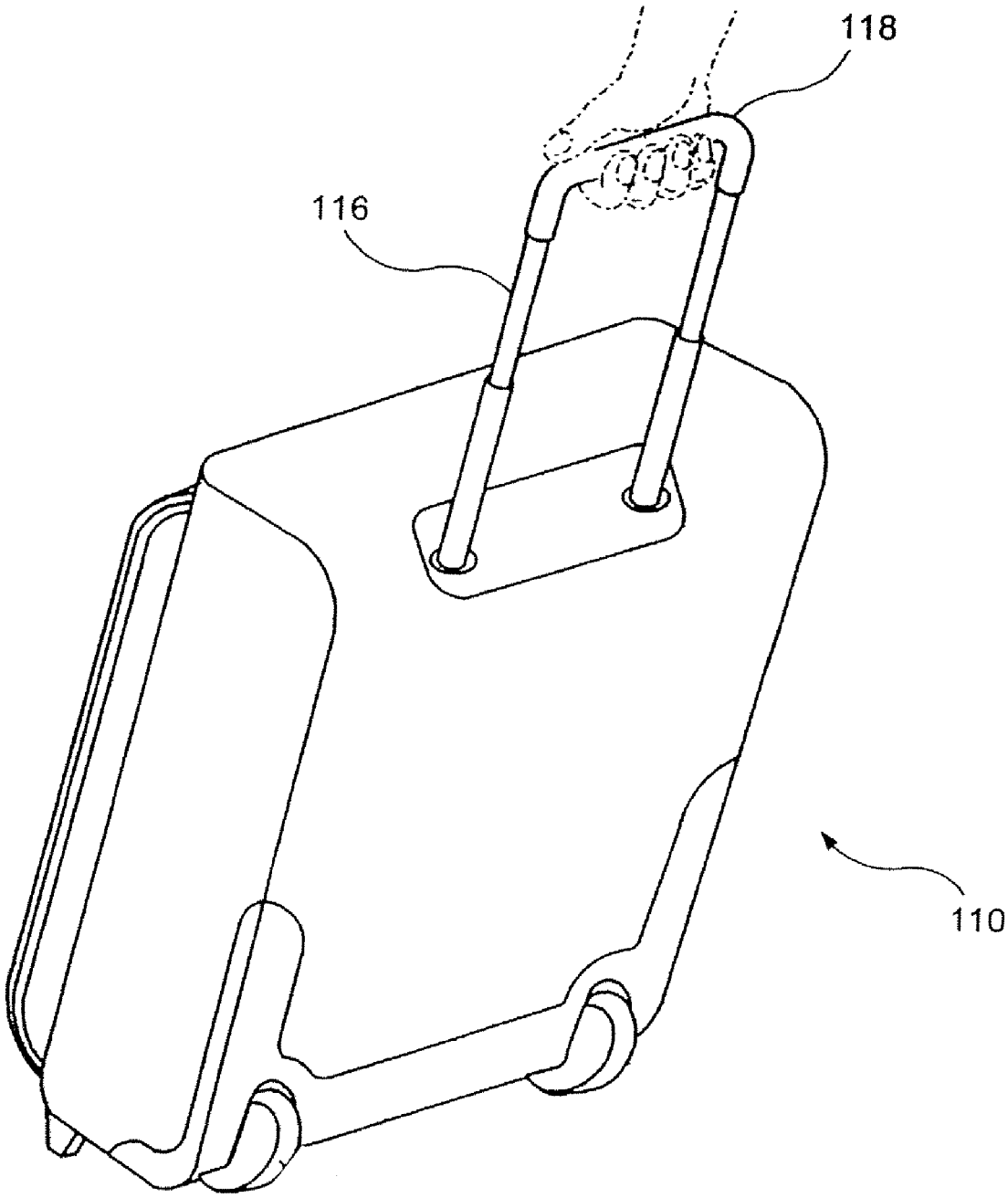
F I G. 1 PRIOR ART
FIG. 1 shows an isometric view of a conventional towing arrangement.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION OF THE PREFERRED EMBODIMENTS

Figure 2:
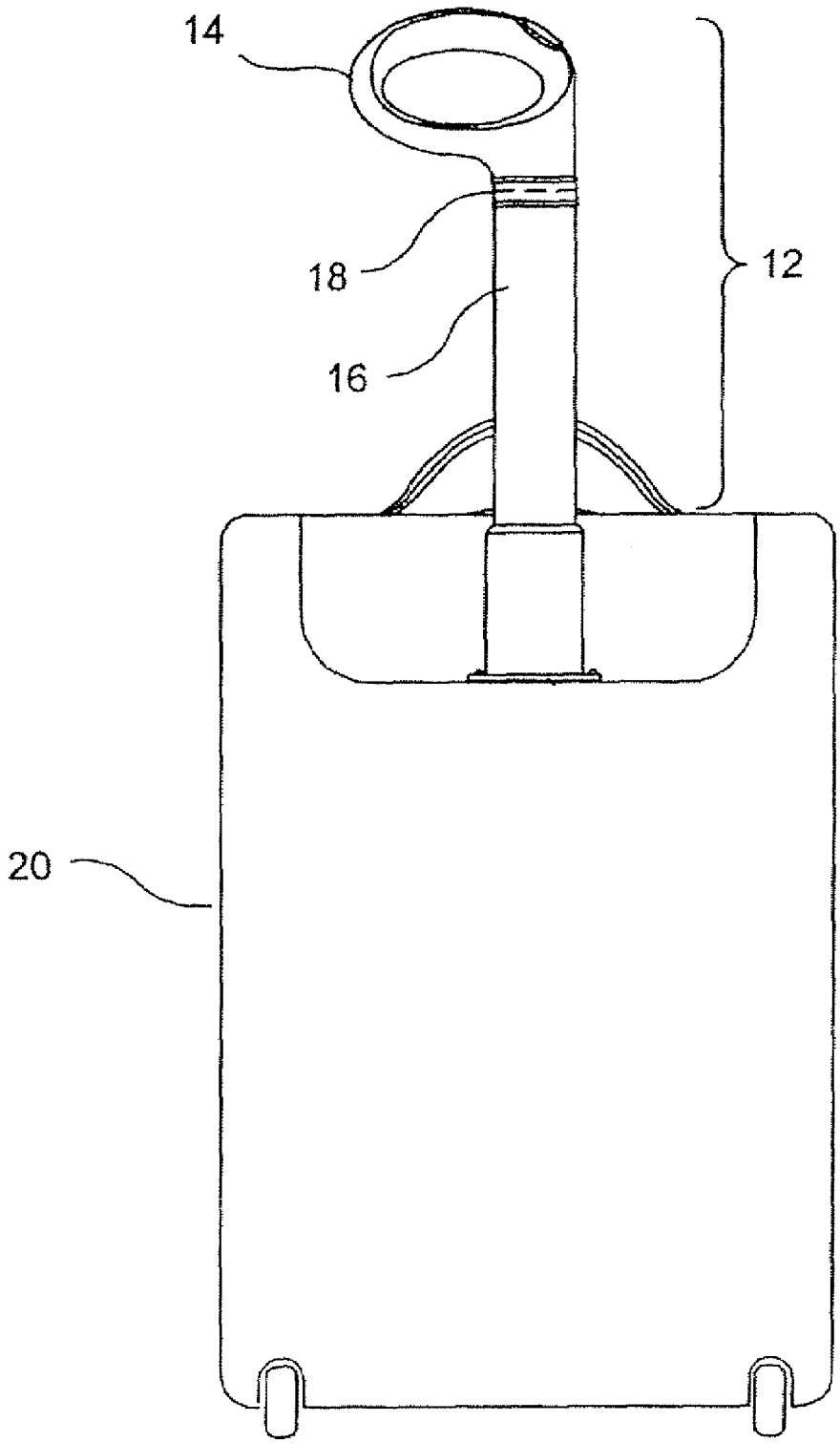
FIG. 2 shows an isometric view of a first exemplary embodiment of a towing arrangement according to the present invention.

FIG. 2 depicts an exemplary embodiment according to the present invention. A towing arrangement 12 may include a handle 14, a tubular member 16, and a handle mechanism 18. The towing arrangement 12 may be attached to a wheeled piece of luggage 20. The handle mechanism 18 may permit the handle to be rotated with the respect to the tubular member 16, and may also permit the tubular member 16 to retract into the luggage 20. The handle 14 may be of a generally oval shape. All of the individual components of the towing arrangement 12 may be fabricated from a material to provide sufficient strength, for example steel or aluminum. Optionally, the towing arrangement 12 may be attached to a cart used to transport a piece of luggage.

Figure 3:
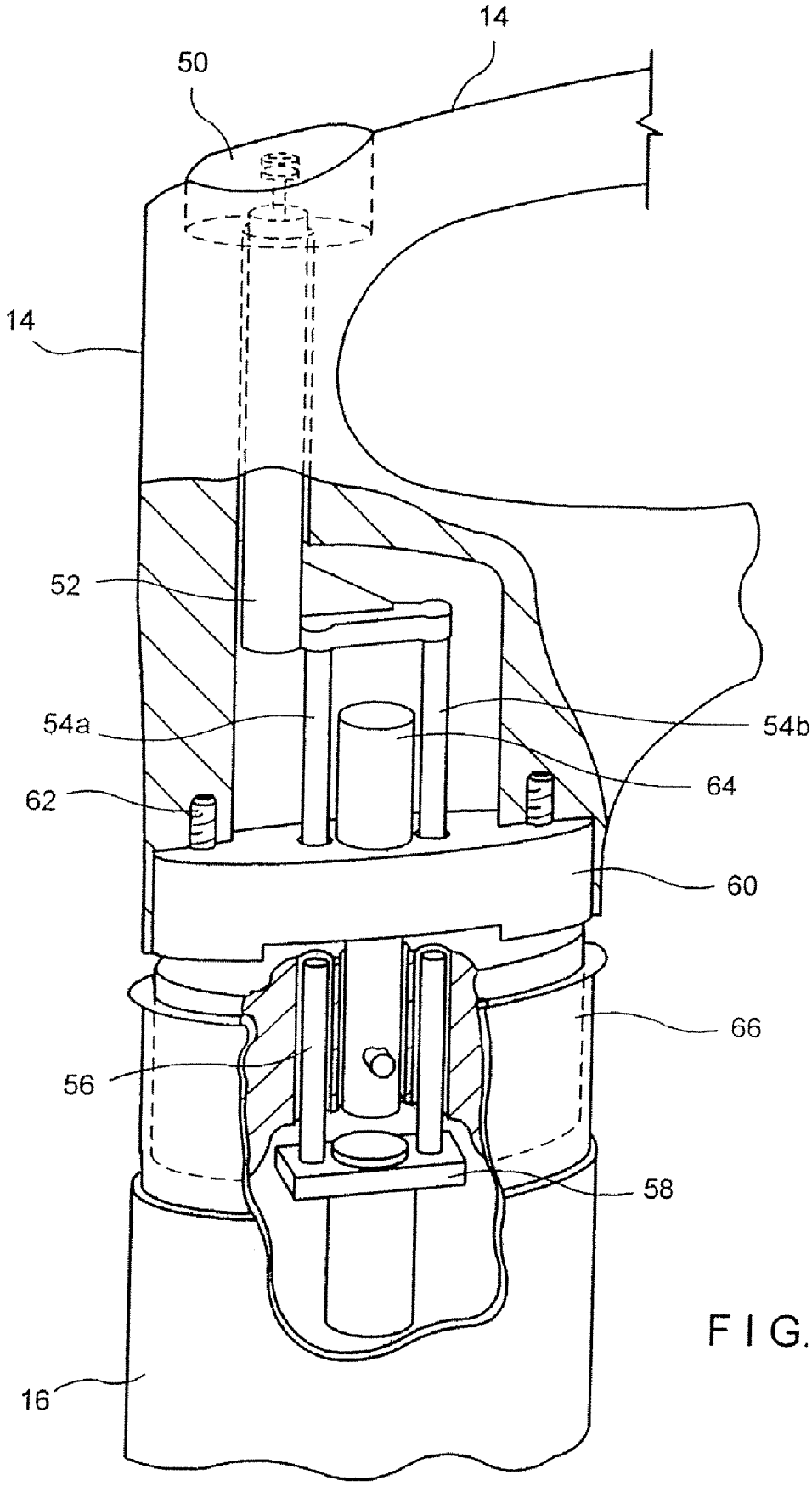
FIG. 3 shows a more detailed isometric view of the towing arrangement of FIG. 2.

FIG. 3 depicts a magnified and more detailed view than FIG. 2. A button 50 may be used to actuate a locking member 52 which may be in the passageway of the handle 14. The locking member 52 may include one or more first protrusions 54*a*, 54*b* which may communicate with second protrusions 56 of support locking member 58. In a preferred embodiment, only one first protrusion 54*a* is provided. The first protrusions 54 may pass through a coverback member 60. The coverback member 60 may be attached to the handle 14 via screws 62. A joint lock 64 may be used to permit rotation between the coverback member 60 and a joint member 66, while also preventing complete separation of the coverback member 60 and the joint member 66 in the direction of the axis of the joint member. The joint member 66 may be attached to the tubular member 16 by a press fit or via a pin connection.

Thus, because the coverback member 60 may be attached to the handle 14, and because the joint member 66 may be attached to the tubular member 16, the joint lock 64 may permit rotation of the handle 14 with respect to the tubular member 16 while also preventing complete separation of the handle 14 and the tubular member 16 in the direction of the axis of the joint member.

Figure 4:
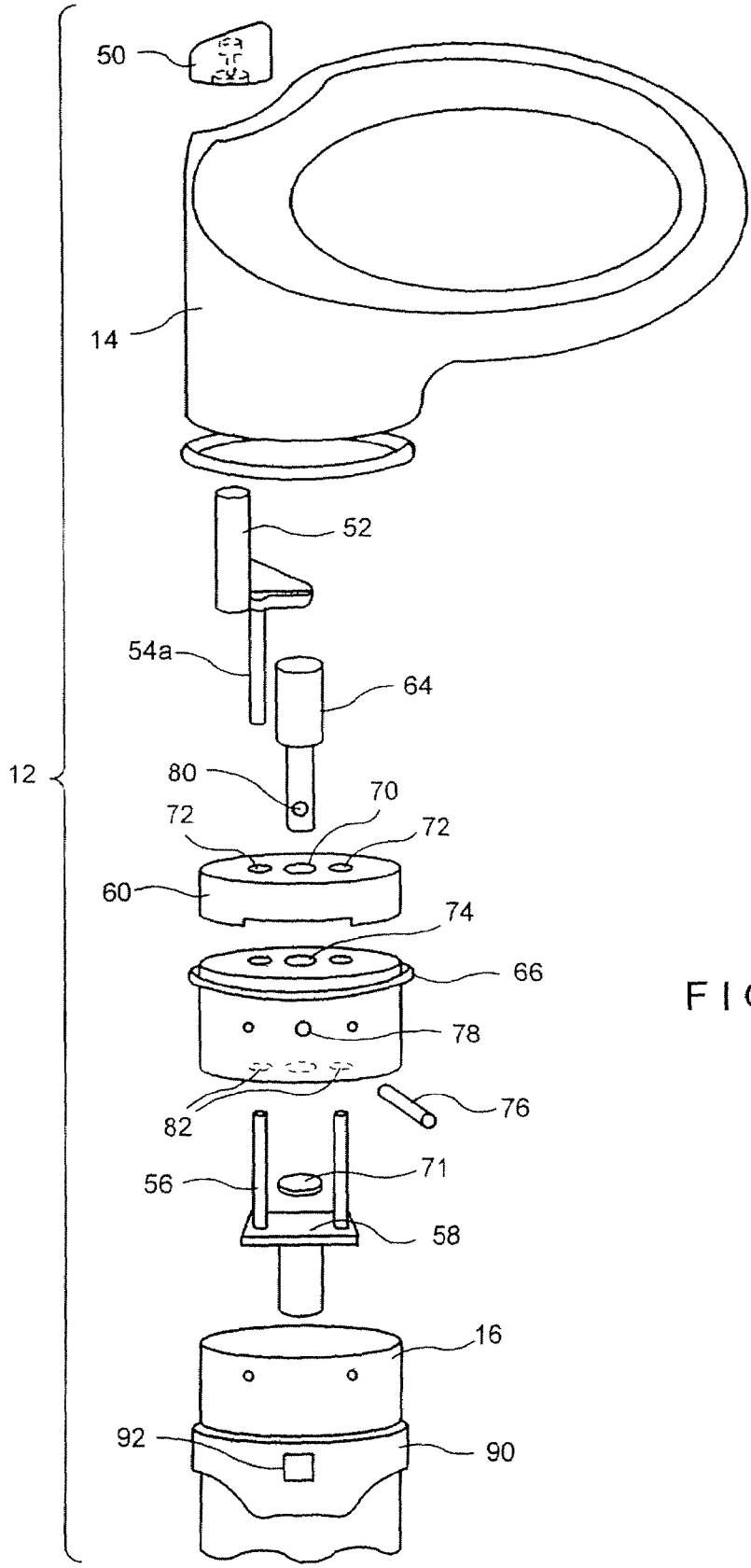
FIG. 4 shows an exploded view of certain components of the towing arrangement of FIG. 2.

As depicted in FIG. 4, the towing arrangement 12 may be assembled using the following steps. The joint lock 64 may be passed through a through-hole 70 of the coverback member 60. The first protrusion 54*a* of the locking member 52 may be placed in one of corresponding holes 72 in the coverback member 60. The coverback member 60 may be placed into one end of the handle 14 and may be attached thereto via screws (not shown). A button 50 may be placed into another end of the handle 14 and may be attached to the locking member 52 via a screw (not shown). A wear plate 71 may be placed over the joint lock 64. The joint lock 64 may be placed in a through hole 74 of the joint member 66. A pin 76 may be assembled though hole 78 in joint member 66 and pressed fit into hole 80 of joint lock 64. The pin 76 may prevent relative motion between the joint lock 64 and the joint member 66. The second protrusions 56 of the support locking member 58 may be passed through corresponding holes 82 in the joint member 66. The joint member 66 may be placed into one end of the tubular member 16 and may be attached thereto via a press fit or via pins. Other components related to the release mechanism are not shown and may be assembled in the tubular member 16 prior to the assembling of the joint member 66 thereto.

The release mechanism (not shown) may keep the support locking member 58 as far as it will fit into the joint member 66 in the direction of the handle 14 because of a spring force, for example, exerted in the release mechanism and will not extend into the coverback member 60. Thus, supporting locking member 58 does not prevent rotation of handle 14 relative to tubular member 16. The locking member 52 may be kept as far as it will fit into the handle 14 in the direction toward the button 50 by a spring, for example (not shown). Except when button 50 is depressed, no part of locking member 52 extends into joint member 66.

A latching member 90 may be slidably attached to the exterior of the tubular member 16 and may be used to fill a gap between the tubular member and the corresponding receptacle 22 in the piece of luggage the tubular member retracts into. The latching member 90 may include a hook feature 92 that keeps the latching member 90 near the top of the receptacle 22.

In operation, when the button 50 is activated, the force therefrom is transferred to the first protrusion 54*a* of the locking member 52, which may communicate with one of the second protrusions 56 of the support locking member 58. These protrusions 54*a*, 56 do not make contact through the axis of the joint lock 64. The support locking member 58 may communicate with another release mechanism (not shown) to permit extension or retraction of the tubular member 16 from the wheeled piece of luggage 20.

Figure 5:
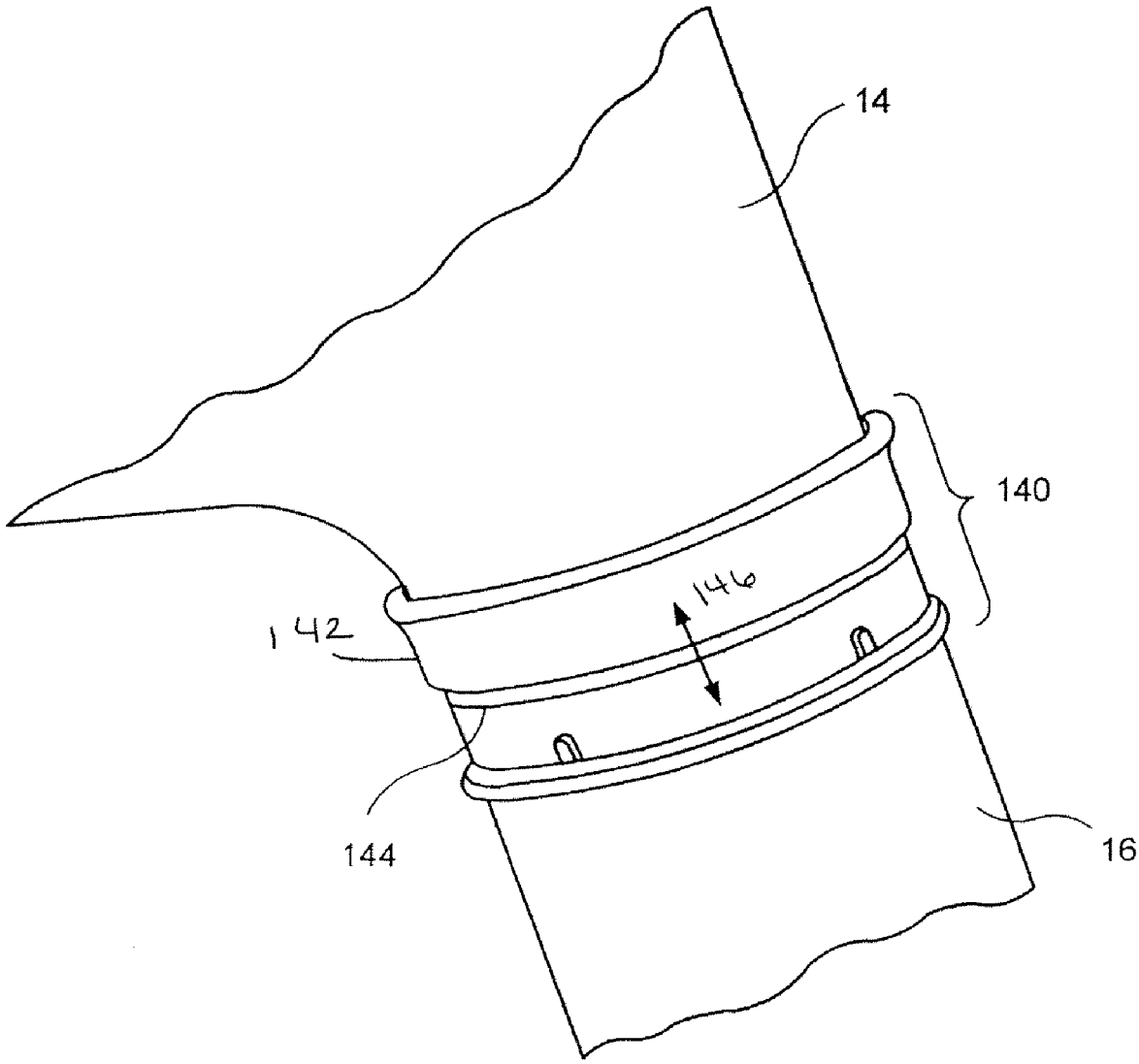
FIG. 5 shows an isometric view of the collar assembly that may be used with the towing arrangement of FIG. 2.

As shown in FIG. 5 and as further described in U.S. Pat. No. 6,857,512, the specification of which has been incorporated by reference in its entirety herein above, the towing arrangement may also include a collar assembly 140. The collar assembly 140 may include a collar 142 slidably mounted on a base portion of the handle 14 for movement in the direction of the axis of elongation of the tubular member 16 between a first axial position, at which the collar 142 is located on the handle side of a dividing line 144 between the handle 14 and the tubular member 16 and permits rotation of the handle 14 relative to the tubular member 16, and a second axial position, at which the collar overlies the dividing line 144 and prevents rotation of the handle 14 relative to the tubular member 16.

The foregoing merely illustrates the principles of the invention. Various modifications and alterations to the described embodiments will be apparent to those skilled in the art in view of the teachings herein. It will thus be appreciated that those skilled in the art will be able to devise numerous systems and methods which, although not explicitly shown or described herein, embody the principles of the invention and are thus within the spirit and scope of the invention.

What is claimed is:

1. A piece of towable luggage comprising:

a piece of luggage;

a tubular member retractably mounted to the piece of luggage, the tubular member having first and second ends, the first end being secured to the piece of luggage, the tubular member including an internal volume;

a handle which includes a passageway, the handle being pivotally connected to the tubular member at the second end;

a joint lock member pivotally connecting the handle to the tubular member; and a first member external and spaced from the joint lock member and in communication with the passageway of the handle, the first member including at least one first member protrusion, the at least one first member protrusion having a first position disposed in the passageway of the handle and not disposed in the internal volume of the tubular member, and a second position wherein at least a portion of the at least one first member protrusion is disposed in the internal volume of the tubular member, wherein the first member and the at least one first member protrusion form a unitary structure.

2. The piece of towable luggage of claim 1 wherein the at least one first member protrusion is a pair of member protrusions communicating with the internal volume.

3. The piece of towable luggage of claim 2 further comprising a second member, the second member residing in the internal volume of the tubular member and including a pair of second member protrusions being aligned with the at least one first member protrusion and, when so aligned, being at least partially displaced along their axes by at least partial displacement of the at least one first member protrusion.

4. The piece of towable luggage of claim 1 wherein the tubular member is substantially symmetrical about a plane including the axis of the joint lock member and the cross section of the tubular member orthogonal to the axis of the joint lock member is not circular.

5. The piece of towable luggage of claim 1 further comprising a button in the handle in communication with the first member such that depressing the button at least partially displaces the first member such that a portion of the at least one first member protrusion extends into the internal volume of the tubular member.

6. The piece of towable luggage of claim 5 wherein the at least one first member protrusion communicates with the internal volume, and the towable luggage further comprises a second member residing in the internal volume of the tubular member and including a pair of second member protrusions being aligned with the at least one first member protrusion and, when at least one of the second member protrusions is so aligned, being at least partially displaced along their axes by at least partial displacement of the at least one first member protrusion.

7. The piece of towable luggage of claim 6 wherein only when the at least one first member protrusion is aligned with at least one of the second member protrusions, depressing the button in the handle at least partially displaces the first member towards the tubular member sufficient for a portion of the at least one first member protrusion to extend into the internal volume of the tubular member.

8. The piece of towable luggage of claim 1 wherein the tubular member is a single-pole tubular member.

9. The piece of towable luggage of claim 1 further comprising a set of wheels rotatably mounted to the piece of luggage.

10. The piece of towable luggage of claim 1 wherein the tubular member has a generally oval cross-section.

11. The piece of towable luggage of claim 1, further comprising:

the tubular member having an axis of elongation;

the handle being mounted at the second end of the tubular member for rotation relative thereto about the axis of elongation, the rotation occurring along a dividing line between a handgrip base portion and an axially adjacent portion of the tubular member; and a collar slidably mounted on the handle in surrounding relation thereto for movement in the direction of the axis of elongation between a first axial position, at which the collar is located on the handle side of the dividing line and permits rotation of the handle relative to the tubular member, and a second axial position, at which the collar axially overlies the dividing line and prevents rotation of the handle relative to the tubular member.

12. A towing arrangement for luggage comprising:

a tubular member retractably mounted to a piece of luggage, the tubular member having first and second ends, the first end being secured to the piece of luggage, the tubular member including an internal volume;

a handle which includes a passageway, the handle being pivotally connected to the tubular member at the second end;

a joint lock member pivotally connecting the handle to the tubular member; and a first member external to the joint lock member and in communication with the passageway of the handle, the first member including at least one first member protrusion, the at least one first member protrusion having a first position disposed in the passageway of the handle and not disposed in the internal volume of the tubular member, and a second position wherein at least a portion of the at least one first member protrusion is disposed in the internal volume of the tubular member.

13. The towing arrangement of claim 12 wherein the first member comprises a pair of first member protrusions communicating with the internal volume.

14. The towing arrangement of claim 13 further comprising a second member, the second member residing in the internal volume of the tubular member and including a pair of second member protrusions capable of being aligned with the pair of first member protrusions and, when so aligned, capable of being at least partially displaced along their axes by at least partial displacement of the pair of first member protrusions.

15. The towing arrangement of claim 14 wherein the tubular member has a generally oval cross-section.

16. The towing arrangement of claim 14 wherein the tubular member is substantially symmetrical about a plane including the axis of the joint lock member and the cross-section of the tubular member orthogonal to the axis of the joint lock member is not circular.

17. The towing arrangement of claim 1 further comprising a button in the handle in communication with the first member such that depressing the button at least partially displaces the first member such that a portion of the at least one first member protrusion extends into the internal volume of the tubular member.

18. The towing arrangement of claim 17 wherein the at least one first member protrusion communicates with the internal volume, and the towing arrangement further comprises a second member residing in the internal volume of the tubular member and including a pair of second member protrusions being aligned with the at least one first member protrusion and, when at least one of the pair of second member protrusions is so aligned, being at least partially displaced along their axes by at least partial displacement of the at least one first member protrusion.

19. The towing arrangement of claim 18 wherein only when the at least one first member protrusion is aligned with at least one of the second member protrusions, depressing the button in the handle at least partially displaces the first member towards the tubular member sufficient for a portion of the at least one first member protrusion to extend into the internal volume of the tubular member.

20. The towing arrangement of claim 19 wherein the tubular member is a single-pole tubular member.

21. The towing arrangement of claim 1 further comprising a set of wheels rotatably mounted on the piece of luggage.

22. The towing arrangement of claim 1 wherein the tubular member is a single-pole tubular member.

23. The towing arrangement of claim 1, further comprising:

the tubular member having an axis of elongation;

the handle being mounted at the second end of the tubular member for rotation relative thereto about the axis of elongation, the rotation occurring along a dividing line between a handgrip base portion and an axially adjacent portion of the tubular member; and a collar slidably mounted on the handle in surrounding relation thereto for movement in the direction of the of-axis of elongation between a first axial position, at which the collar is located on the handle side of the dividing line and permits rotation of the handle relative to the tubular member, and a second axial position, at which the collar axially overlies the dividing line and prevents rotation of the handle relative to the tubular member.

24. A towing arrangement for luggage comprising:

a tubular member retractably mounted to a piece of luggage, the tubular member having first and second ends, the first end being secured to the piece of luggage, the tubular member including an internal volume;

a handle which includes a passageway, the handle being pivotally connected to the tubular member at the second end;

a joint lock member pivotally connecting the handle to the tubular member; and a first member external to the joint lock member and in communication with the passageway of the handle, the first member including at least one first member protrusion, the at least one first member protrusion having a first position disposed in the passageway of the handle, and a second position wherein at least a portion of the at least one first member protrusion is disposed in the internal volume of the tubular member, wherein the first member comprises a pair of first member protrusions communicating with the internal volume, wherein the pair of first member protrusions are in line with and on opposite sides of the joint lock member.

25. A towing arrangement for luggage comprising:

a tubular member retractably mounted to a piece of luggage, the tubular member having first and second ends, the first end being secured to the piece of luggage, the tubular member including an internal volume;

a handle which includes a passageway, the handle being pivotally connected to the tubular member at the second end;

a joint lock member pivotally connecting the handle to the tubular member; and a first member in communication with the passageway of the handle, wherein the first member comprises at least one first member protrusion, the at least one first member protrusion having a first position disposed in the passageway of the handle and not disposed in the internal volume of the tubular member, and a second position wherein at least a portion of the at least one first member protrusion is disposed in the internal volume of the tubular member; and a second member residing in the internal volume of the tubular member and including at least one second member protrusion adapted to align with the at least one first member protrusion.

26. The towing arrangement of claim 25 wherein the first member comprises a pair of first member protrusions communicating with the internal volume.

27. The towing arrangement of claim 25 wherein the second member resides in the internal volume of the tubular member and includes a pair of second member protrusions being aligned with the at least one first member protrusion and being at least partially displaced along their axes by the at least one first member protrusion.

28. The towing arrangement of claim 27 further comprising a button in the handle in communication with the first member such that depressing the button at least partially displaces the first member such that a portion of the at least one first member protrusion extends into the internal volume of the tubular member.

29. The towing arrangement of claim 25 wherein the tubular member has a generally oval cross-section.

30. The towing arrangement of claim 25 wherein the tubular member is substantially symmetrical about a plane including the axis of the joint locking member.

31. The towing arrangement of claim 25 further comprising a set of wheels rotatably mounted on the piece of luggage.

32. The towing arrangement of claim 25 wherein the tubular member is a single-pole tubular member.

33. The towing arrangement of claim 25, further comprising:

the tubular member having an axis of elongation;

the handle being mounted at the second end of the tubular member for rotation relative thereto about the axis of elongation, the rotation occurring along a dividing line between a handgrip base portion and an axially adjacent portion of the tubular member; and a collar slidably mounted on the handle in surrounding relation thereto for movement in the direction of the of-axis of elongation between a first axial position, at which the collar is located on the handle side of the dividing line and permits rotation of the handle relative to the tubular member, and a second axial position, at which the collar axially overlies the dividing line and prevents rotation of the handle relative to the tubular member.

34. A towing arrangement for luggage comprising:

a tubular member retractably mounted to a piece of luggage, the tubular member having first and second ends, the first end being secured to the piece of luggage, the tubular member including an internal volume;

a handle which includes a passageway, the handle being pivotally connected to the tubular member at the second end;

a joint lock member pivotally connecting the handle to the tubular member; and a first member in communication with the passageway of the handle, wherein the first member comprises at least one first member protrusion, the at least one first member protrusion having a first position disposed in the passageway of the handle, and a second position wherein at least a portion of the at least one first member protrusion is disposed in the internal volume of the tubular member; and a second member residing in the internal volume of the tubular member and including at least one second member protrusion adapted to align with the at least one first member protrusion, wherein the first member comprises a pair of first member protrusions communicating with the internal volume, wherein the pair of first member protrusions are in line with and on opposite sides of the joint lock member.

* * * * *